US007177568B2

(12) United States Patent
Taguchi et al.

(10) Patent No.: US 7,177,568 B2
(45) Date of Patent: Feb. 13, 2007

(54) IMAGE FORMING APPARATUS AND AN IMAGE FORMING METHOD

(75) Inventors: Keiichi Taguchi, Nagano-ken (JP); Ken Yoshizuka, Nagano-ken (JP); Osamu Ishibashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 165 days.

(21) Appl. No.: 11/069,751

(22) Filed: Feb. 28, 2005

(65) Prior Publication Data

US 2005/0220460 A1 Oct. 6, 2005

(30) Foreign Application Priority Data

Mar. 5, 2004 (JP) ..... 2004-061692
Mar. 5, 2004 (JP) ..... 2004-061695
Feb. 3, 2005 (JP) ..... 2005-027538

(51) Int. Cl.
*G03G 21/00* (2006.01)

(52) U.S. Cl. ..... 399/127; 399/12; 399/226; 399/227

(58) Field of Classification Search ..... 399/228, 399/226, 227, 10, 9, 12, 127
See application file for complete search history.

(56) References Cited

U.S. PATENT DOCUMENTS 5,243,395 A * 9/1993 Koike et al. ..... 399/226
6,253,035 B1 6/2001 Kawana et al.
2005/0196181 A1* 9/2005 Taguchi et al. ..... 399/12

FOREIGN PATENT DOCUMENTS

JP 2002-351190 12/2002
JP 2003-215862 7/2003

* cited by examiner

*Primary Examiner*—Susan Lee
(74) *Attorney, Agent, or Firm*—Hogan & Hartson LLP

(57) ABSTRACT

Prior to execution of a printing operation, a print preparatory operation is conducted collectively on all developer cartridges mounted to a developing unit, thereby bringing all the developer cartridges into a printable state. Therefore, even if a residual amount of toner in the cartridge runs too low to continue the printing operation performed using one of plural cartridges mounted to the developing unit, the printing operation is allowed to continue by switching the cartridge to the next cartridge. Hence, a large volume of monochromatic prints may be produced in an efficient manner.

18 Claims, 13 Drawing Sheets

FIG. 4

| | POSITIONING STATE OF DEVELOPING UNIT | OPERATION/PRINTABLE STATE |
|---|---|---|
| (a) | IMMEDIATELY AFTER START OF PRINT PREPARATORY PROCESS<br>4Kd 4Ka 4Kc 4Kb | CONDUCT ON ALL CARTRIDGES 4Ka-4Kd:<br>MOUNTING CONFIRMATION<br>SUITABILITY CONFIRMATION, AND<br>LIFE CONFIRMATION |
| (b) | CARTRIDGE 4Ka: DEVELOPMENT POSITION<br>4Kd 4Ka 4Kc 4Kb | CONDUCT ON CARTRIDGE 4Ka:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (c) | CARTRIDGE 4Kb: DEVELOPMENT POSITION<br>4Ka 4Kb 4Kd 4Kc | CONDUCT ON CARTRIDGE 4Kb:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (d) | CARTRIDGE 4Kc: DEVELOPMENT POSITION<br>4Kb 4Kc 4Ka 4Kd | CONDUCT ON CARTRIDGE 4Kc:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (e) | CARTRIDGE 4Kd: DEVELOPMENT POSITION<br>4Kc 4Kd 4Kb 4Ka | CONDUCT ON CARTRIDGE 4Kd:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (f) | PRINT PREPARATORY PROCESS COMPLETED (HP)<br>4Kd 4Kc 4Ka 4Kb | BECOME PRINTABLE BY EACH OF CARTRIDGES 4Ka-4Kd |

FIG. 8

| | POSITIONING STATE OF DEVELOPING UNIT | OPERATION/PRINTABLE STATE |
|---|---|---|
| (a) | IMMEDIATELY AFTER START OF PRE-PRINT PROCESS<br>4Kd 4Ka 4Kc 4Kb | CHECK ALL CARTRIDGES 4Ka-4Kd TO DETERMINE WHETHER USABLE (OK) OR UNUSABLE (NG)<br>MOUNTING DETERMINATION, SUITABILITY DETERMINATION, AND LIFE DETERMINATION |
| (b) | IMMEDIATELY AFTER USABLE/UNUSABLE DETERMINATION<br>4Kd NG 4Ka OK OK 4Kc OK 4Kb | WHERE 3 CARTRIDGES 4Ka-4Kc ARE DETERMINED TO BE USABLE |
| (c) | CARTRIDGE 4Ka: DEVELOPMENT POSITION<br>4Kd NG OK 4Ka OK OK 4Kc 4Kb | CONDUCT ON CARTRIDGE 4Ka:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (d) | CARTRIDGE 4Kb: DEVELOPMENT POSITION<br>4Ka OK OK 4Kb 4Kd NG OK 4Kc | CONDUCT ON CARTRIDGE 4Kb:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (e) | CARTRIDGE 4Kc: DEVELOPMENT POSITION<br>4Kb OK OK 4Kc 4Ka OK NG 4Kd | CONDUCT ON CARTRIDGE 4Kc:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (f) | PRE-PRINT PROCESS COMPLETED (HP)<br>NG 4Kc 4Ka 4Kb | BECOME PRINTABLE BY ALL CARTRIDGES 4Ka-4Kc DETERMINED TO BE USABLE |

FIG. 12

| | POSITIONING STATE OF DEVELOPING UNIT | OPERATION/PRINTABLE STATE |
|---|---|---|
| (a) | IMMEDIATELY AFTER START OF PRE-PRINT PROCESS<br>4Kd 4Ka 4Kc 4Kb | CHECK ALL CARTRIDGES 4Ka-4Kd TO DETERMINE WHETHER USABLE (OK) OR UNUSABLE (NG)<br>MOUNTING DETERMINATION, SUITABILITY DETERMINATION, AND LIFE DETERMINATION |
| (b) | IMMEDIATELY AFTER USABLE/UNUSABLE DETERMINATION<br>4Kd NG 4Ka OK OK 4Kc OK 4Kb | WHERE 3 CARTRIDGES 4Ka-4Kc ARE DETERMINED TO BE USABLE<br>DETERMINE WHETHER LIFE LEVEL IS MIXED |
| (c) | NARROW DOWN USABLE CARTRIDGES<br>4Kd NG 4Ka NG OK 4Kc OK 4Kb | WHERE LIFE LEVEL LT1:<br>CARTRIDGES 4Ka, 4Kb<br>LIFE LEVEL LT2:<br>CARTRIDGE 4Kc,<br>USABLE CARTRIDGES ARE NARROWED DOWN TO CARTRIDGES 4Ka, 4Kb |
| (d) | CARTRIDGE 4Ka: DEVELOPMENT POSITION<br>4Kd NG OK 4Ka 4Kc NG OK 4Kb | CONDUCT ON CARTRIDGE 4Ka:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (e) | CARTRIDGE 4Kb: DEVELOPMENT POSITION<br>4Ka OK OK 4Kb 4Kd NG NG 4Kc | CONDUCT ON CARTRIDGE 4Kb:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (f) | PRE-PRINT PROCESS COMPLETED (HP)<br>NG NG 4Ka 4Kb | BECOME PRINTABLE BY ALL USABLE CARTRIDGES 4Ka, 4Kb |

FIG. 13

| | POSITIONING STATE OF DEVELOPING UNIT | OPERATION/PRINTABLE STATE |
|---|---|---|
| (a) | IMMEDIATELY AFTER START OF PRE-PRINT PROCESS<br>4Kd 4Ka 4Kc 4Kb | CHECK ALL CARTRIDGES 4Ka-4Kd TO DETERMINE WHETHER USABLE (OK) OR UNUSABLE (NG)<br>MOUNTING DETERMINATION, SUITABILITY DETERMINATION, AND LIFE DETERMINATION |
| (b) | IMMEDIATELY AFTER USABLE/UNUSABLE DETERMINATION<br>4Kd NG 4Ka OK OK 4Kc OK 4Kb | WHERE 3 CARTRIDGES 4Ka-4Kc ARE DETERMINED TO BE USABLE<br>PRINTABLE CARTRIDGES 4Ka, 4Kb<br>UNPRINTABLE CARTRIDGE 4Kc |
| (c) | CARTRIDGE 4Kc: DEVELOPMENT POSITION<br>4Kb OK OK 4Kc 4Ka OK NG 4Kd | CONDUCT ON CARTRIDGE 4Kc:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (d) | PRE-PRINT PROCESS COMPLETED (HP)<br>NG 4Kc 4Ka 4Kb | BECOME PRINTABLE BY ALL CARTRIDGES 4Ka-4Kc DETERMINED TO BE USABLE |

IMAGE FORMING APPARATUS AND AN IMAGE FORMING METHOD

CROSS REFERENCE TO RELATED APPLICATION

The disclosure of Japanese Patent Applications enumerated below including specification, drawings and claims is incorporated herein by reference in its entirety:

No. 2004-61692 filed Mar. 5, 2004;

No. 2004-61695 filed Mar. 5, 2004; and

No. 2005-27538 filed Feb. 3, 2005.

BACKGROUND OF THE INVENTION

1. Field of the Invention

The present invention relates to an image forming apparatus and an image forming method performing a printing operation while selectively transferring one of plural cartridges having toner of a specific color to a development position, the printing operation performed using the toner in the cartridge positioned at the development position.

2. Description of the Related Art

Heretofore, there have been widely known image forming apparatuses adapted to form an image using a plurality of developer cartridges. For instance, Japanese Unexamined Patent Publication No. 2003-215862 discloses a color image forming apparatus including a rotary developing unit having four developer cartridges radially arranged about a rotating shaft. In this apparatus, the rotating shaft is driven into rotation for selectively positioning one of the four developer cartridges at a development position opposite to a latent image carrier such as a photosensitive member so as to develop a latent image on the latent image carrier. Subsequently, the developed image is transferred to an intermediate transfer medium. The developing process and the transfer process are repeated the same way as the above while switching from one developer cartridge to another, whereby toner images of plural colors are superimposed on top of each other to form a color image.

In the aforementioned color image forming apparatus, the four developer cartridges contain therein toners of individually different colors (yellow, cyan, magenta and black) so as to perform the printing operation for color image. Therefore, there occurs a problem that in a case where the above image forming apparatus is used for printing monochromatic images, the above image forming apparatus runs out of the black toner faster than an image forming apparatus dedicated to monochromatic image printing. In order to overcome such a problem, there has been proposed an apparatus wherein black developer cartridge(s) is(are) mounted to place(s) where the yellow, cyan and/or magenta developer cartridge(s) are mounted, and wherein when one of the black developer cartridges runs out of the black toner, the developer cartridge is switched to another black developer cartridge so as to permit the continuation of the monochromatic printing operation (see, for example, Japanese Unexamined Patent Publication No. 2002-351190).

SUMMARY OF THE INVENTION

By the way, in order to ensure that the images are favorably printed using toner in a developer cartridge, it is necessary to conduct in advance a print preparatory operation on the developer cartridge. The print preparatory operation is typically exemplified by an optimization process (a patch process). According to the apparatus set forth in Japanese Unexamined Patent Publication No. 2003-215862, for example, the optimization process (equivalent to a "condition control process" of the present invention) is conducted at a proper time prior to the printing operation. For example, the optimization process may be conducted immediately after turn-on of the apparatus, after warm-up of the apparatus or in parallel with the warm-up of the apparatus. In the optimization process, optimum values of a developing bias and an exposure power, as density control factors affecting the image quality, are calculated based on detected densities of solid images or half-toned images formed as patch images. In the execution of the printing operation, the developing bias and the exposure power are set to the respective optimum values thus calculated. Thus are obtained the optimum printing operation conditions. Images of good and consistent quality may be formed by performing the printing operation under the printing operation conditions thus optimized. In view of the importance of the print preparatory operation, a variety of proposals have been made on the print preparatory operation in the color image forming apparatuses.

In contrast, the apparatus disclosed in Japanese Unexamined Patent Publication No. 2002-351190 or the apparatus provided with a plurality of developer cartridges containing the black toner does not give adequate consideration to the print preparatory process which is important in performing the favorable printing operation. The apparatus mounted with the plural black developer cartridges, for example, is capable of continuously producing a large volume of monochromatic prints by performing the monochromatic printing while selectively transferring one of the developer cartridges to the development position and using the toner contained in the cartridge positioned at the development position. When one developer cartridge is switched to another, however, if the print preparatory operation has not been conducted on the cartridge to be positioned at the development position, the print preparatory operation must be conducted on the cartridge before the printing operation is performed using the cartridge. Hence, the monochromatic printing is temporarily interrupted. In consequence, a problem may occur that a large volume of prints cannot be produced efficiently.

Further, the execution of the print preparatory operation on the developer cartridge mounted to the developing unit does not always enable the printing using the developer cartridge, because it is practically impossible to perform the printing operation if, for example, a required amount of toner for performing the printing operation does not remain in the cartridge mounted to the developing unit. Therefore, the execution of the print preparatory operation on the developer cartridge, which is not usable for printing, leads to the waste of time and electric power, and is inefficient in terms of time and economy.

The present invention has been accomplished in light of the foregoing problem. It is an object of the invention to permit an image forming apparatus to print in a specific color a great amount in an efficient manner, the apparatus capable of performing a printing operation while selectively transferring one of plural cartridges having toner of the specific color to a development position, the printing operation performed using the toner contained in the cartridge positioned at the development position.

It is another object of the invention to increase an efficiency of printing in the specific color.

According to a first aspect of the present invention, there is provided an image forming apparatus, comprising: a latent image carrier capable of carrying thereon an electrostatic latent image; a developing unit having a plurality of cartridges which are freely mounted to and removed from the developing unit and which contain toner of a specific color; and a controller which performs a printing operation while selectively transferring one of the plurality of cartridges mounted to the developing unit at a development position, the printing operation in which the electrostatic latent image on the latent image carrier is developed using the toner in the cartridge positioned at the development position, wherein the controller conducts a print preparatory operation collectively on all the plurality of cartridges mounted to the developing unit, the print preparatory operation conducted on the cartridges prior to the printing operation in order to enable the printing operation by means of the cartridges.

According to a second aspect of the present invention, there is provided an image forming method of an apparatus which comprises a latent image carrier capable of carrying thereon an electrostatic latent image, and a developing unit having a plurality of cartridges which are freely mounted to and removed from the developing unit and which contain toner of a specific color, wherein a printing operation is executed while selectively transferring one of the plurality of cartridges mounted to the developing unit to a development position, the printing operation in which the electrostatic latent image on the latent image carrier is developed using the toner in the cartridge positioned at the development position, and a print preparatory operation is conducted collectively on each of the plurality of cartridges mounted to the developing unit, the print preparatory operation conducted on the cartridge prior to the execution of the printing operation to enable the printing operation by means of the cartridge.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 4 is a schematic diagram showing a print preparatory operation conducted in the image forming apparatus of FIG. 1.

FIG. 8 is a schematic diagram showing a pre-print operation conducted in the second embodiment.

FIG. 12 is a schematic diagram showing a pre-print operation conducted in the fourth embodiment.

FIG. 13 is a schematic diagram showing a pre-print operation conducted in the fifth embodiment.

DETAILED DESCRIPTION OF THE PREFERRED EMBODIMENT

First Embodiment

Now referring to the accompanying drawings, description is made on an embodiment of the present invention implemented in the image forming apparatus (color printer) disclosed in Japanese Unexamined Patent Publication No. 2003-215862. In other words, in this embodiment, the description is made on a specific example in a single color printing or monochromatic printing using black toner contained in four developer cartridges.

Figure 1:
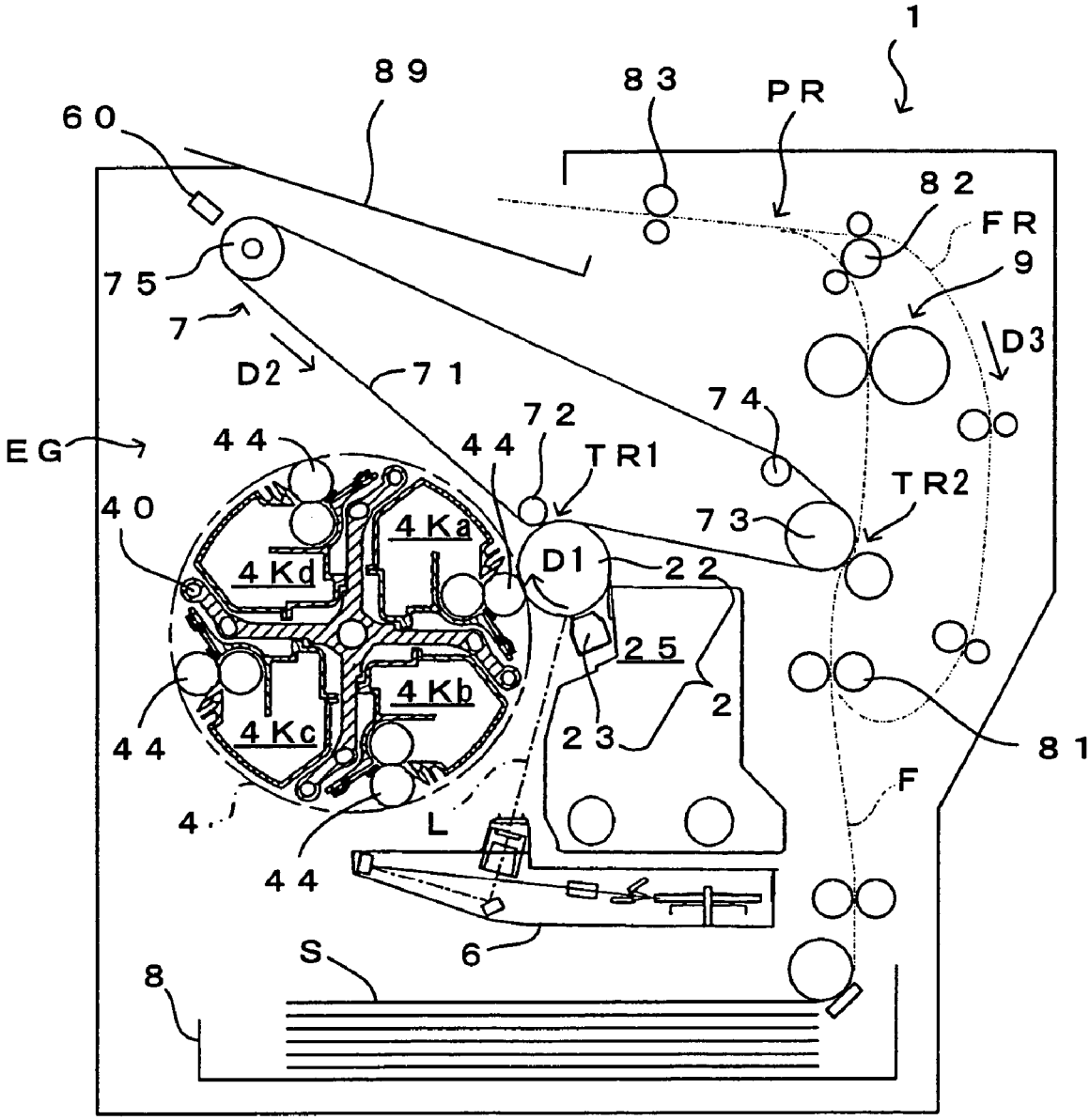
FIG. 1 is a diagram showing a preferred embodiment of an image forming apparatus according to the present invention.
Figure 2:
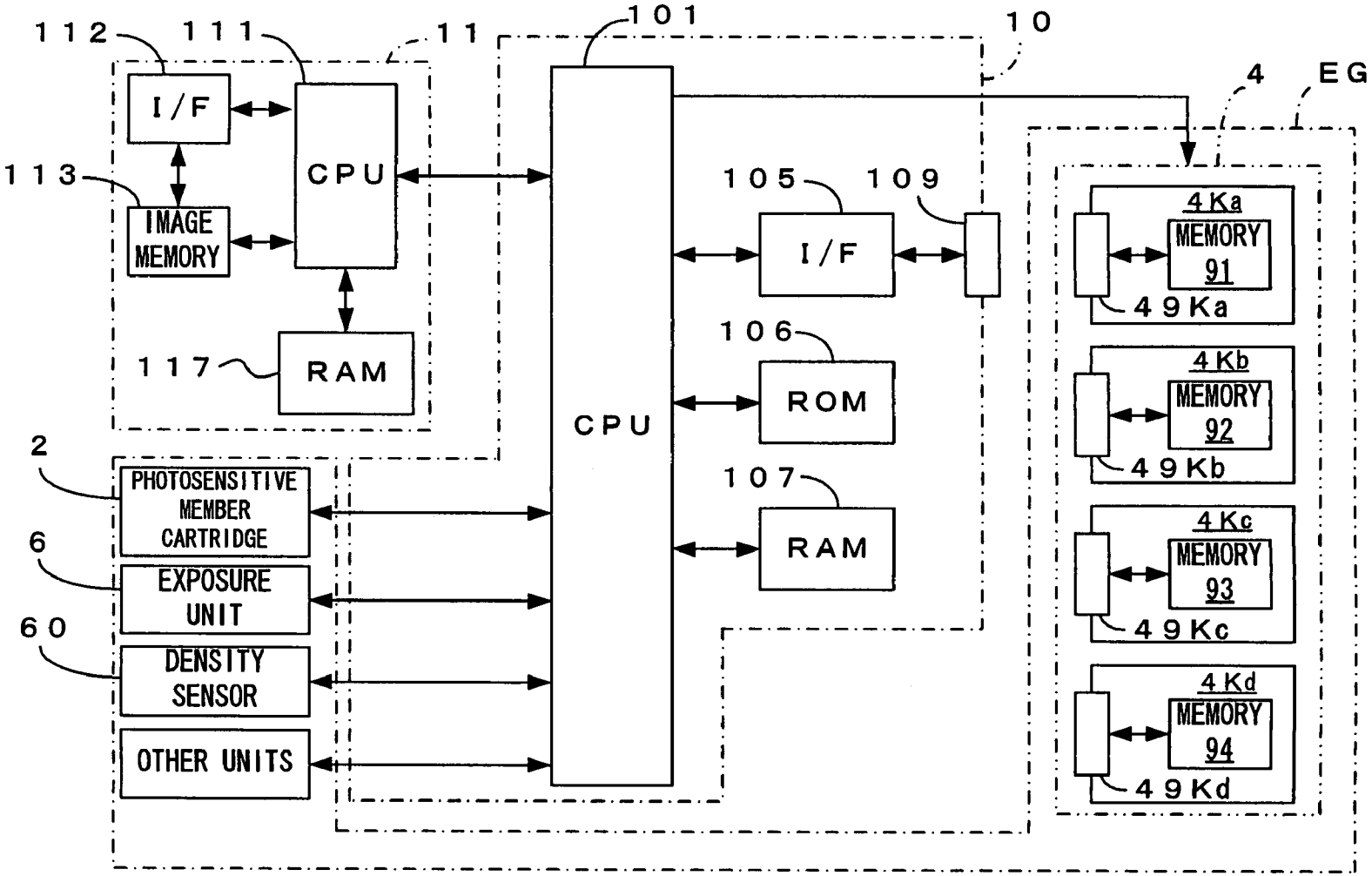
FIG. 2 is a block diagram showing an electrical arrangement of the image forming apparatus of FIG. 1.

FIG. 1 is a diagram showing a preferred embodiment of an image forming apparatus according to the present invention. FIG. 2 is a block diagram showing an electrical arrangement of the image forming apparatus of FIG. 1. The apparatus 1 is an image forming apparatus operative to form monochromatic images using only the black (K) toner. In this image forming apparatus 1, when an image signal is supplied to a main controller 11 from an external apparatus such as a host computer, an engine controller 10 responds to a command from the main controller 11 so as to execute a predetermined image forming operation by controlling individual parts of an engine section EG, thereby forming on a sheet S a monochromatic image corresponding to the image signal.

The engine section EG is provided with a photosensitive member 22 which is rotatable in a direction D1 of an arrow in FIG. 1. A charger unit 23, a rotary developing unit 4 and a cleaner 25 are disposed around the photosensitive member 22 along the direction D1 of the rotation thereof. The charger unit 23 is applied with a predetermined charging bias for uniformly charging an outer circumferential surface of the photosensitive member 22 to a predetermined surface potential. The cleaner 25 operates to remove remaining toner from the surface of the photosensitive member 22 after a primary image transfer, and to collect the removed toner in a waste toner tank disposed therein. The photosensitive member 22, the charger unit 23 and the cleaner 25 integrally constitute a photosensitive member cartridge 2. The photosensitive member cartridge 2, as a unit, is freely mounted to and removed from a main body of the apparatus 1.

A light beam L from an exposure unit 6 is irradiated on the outer circumferential surface of the photosensitive member 22 thus charged by the charger unit 23. The exposure unit 6 irradiates the light beam L on the photosensitive member 22 according to the image signal applied from the external apparatus, thereby forming an electrostatic latent image corresponding to the image signal. In the embodiment, thus, the photosensitive member 22 is equivalent to a "latent image carrier" of the present invention.

The electrostatic latent image thus formed is developed with toner by means of the developing unit 4. The developing unit 4 includes a support frame 40 freely rotatable about a rotating shaft perpendicular to the plane of FIG. 1, four developer cartridges 4Ka to 4Kd each structured as a cartridge free to be mounted to or removed from the support frame 40 and each containing therein the black toner, and a rotary driver (not shown) for driving these components into unitary rotation. The developing unit 4 is controlled by the engine controller 10. Based on a control command from the engine controller 10, when the developing unit 4 is driven into rotation and any one of the developer cartridges 4Ka to 4Kd is selectively positioned at a predetermined development position which is an abutting position against the photosensitive member 22 or an opposed position against the photosensitive member 22 via a predetermined gap therebetween, a developing roller 44 disposed in the developer cartridge thus positioned supplies the toner to the surface of the photosensitive member 22. Thus, the electrostatic latent image on the photosensitive member 22 is developed with the toner contained in the developer cartridge positioned at the development position (printing operation). Thus, the visualization of the electrostatic latent image by means of the developer cartridge positioned at the development position is equivalent to a "printing operation by means of the cartridge" of the present invention.

The toner image developed by the developing unit 4 in the aforementioned manner is primarily transferred onto an intermediate transfer belt 71 of a transfer unit 7 at a primary transfer region TRI. The transfer unit 7 includes the intermediate transfer belt 71 stretched across a plurality of rollers 72 to 75, and a driver which drives the roller 73 into rotation thereby revolving the intermediate transfer belt 71 in a predetermined revolving direction D2. The transfer unit 7 forms a monochromatic image by transferring the black toner image formed on the photosensitive member 22 onto the intermediate transfer belt 71 and then, secondarily transfers the monochromatic image onto a sheet S which is picked up from a cassette 8 one by one and is transported along a transportation path F to a secondary transfer region TR2.

In this process, timing of feeding the sheet S to the secondary transfer region TR2 is controlled so as to transfer the image on the intermediate transfer belt 71 onto the sheet S exactly at a predetermined position. Specifically, a gate roller 81 is provided on the transportation path F at a place upstream from the secondary transfer region TR2 and as the gate roller 81 is rotated in synchronization to the timing of the revolving movement of the intermediate transfer belt 71, the sheet S is fed into the secondary transfer region TR2 at a predetermined timing.

Further, the sheet S now bearing the monochromatic image is transported to a discharge tray 89, which is disposed at a top side portion of the apparatus main body, via a fixing unit 9, a pre-discharge roller 82 and a discharge roller 83. In a case where images are formed on the both sides of the sheet S, the rotation of the discharge roller 83 is reversed at the point of time that a trailing end of the sheet S with the image thus formed on one side thereof is transported to a reversal position PR downstream from the pre-discharge roller 82. Thus, the sheet S is transported along a reversal transport path FR in a direction of an arrow D3. Thereafter, the sheet S is loaded again on the transportation path F at a place upstream from the gate roller 81. At this time, the sheet S is positioned such that the opposite side from the side to which the image is previously transferred is to be pressed against the intermediate transfer belt 71 for image transfer in the secondary transfer region TR2. It is possible to form images on the both sides of the sheet S in this manner.

Further, a density sensor 60 is disposed in proximity of the roller 75. The density sensor 60 confronts a surface of the intermediate transfer belt 71 and measures, as needed, an image density of the toner image formed on an outside surface of the intermediate transfer belt 71. Based on the measurement results, the apparatus adjusts the operating conditions, for example, the developing bias applied to each developer cartridge, the intensity of the light beam L and the like, of the individual parts thereof which may affect the image quality.

The density sensor 60 is arranged to output a signal corresponding to an image density of a region of a given area on the intermediate transfer belt 71 using a reflective photosensor, for example. A CPU 101 is adapted to detect image densities of individual parts of the toner image on the intermediate transfer belt 71 by periodically sampling the output signals from the density sensor 60 while moving the intermediate transfer belt 71 in revolution.

Further, as shown in FIG. 2, the developer cartridges 4Ka to 4Kd are provided with memories 91 to 94, respectively, each memory storing data relating to the production lot, operation history of the developer cartridge, the residual quantity of toner contained therein, and the like. The developer cartridges 4Ka to 4Kd are further provided with wireless communication devices 49Ka, 49Kb, 49Kc, 49Kd, respectively. Whenever necessary, a selected one of these communication devices performs non-contact data communications with a wireless communication device 109 disposed in the main body, and the data transmission/reception via an interface 105 is carried out between the CPU 101 and each of the memories 91 to 94, thereby managing a variety of information items, such as an information item on a consumable article and the like of the developer cartridge. In the embodiment, the non-contact data transmission/reception is carried out by using electromagnetic means such as a wireless communication device. Alternatively, the main body and the individual developer cartridges may be provided with connectors or the like and a respective pair of corresponding connectors may be mechanically fitted with each other for transmitting the data with each other.

In FIG. 2, a reference symbol 113 represents an image memory disposed in the main controller 11 for storing an image supplied from the external apparatus such as a host computer via an interface 112. A reference symbol 117 represents a RAM for temporarily storing operation results given by a CPU 111 and other data. A reference symbol 106 represents a ROM for storing an operation program executed by the CPU 101, control data used for controlling the engine section EG, and the like. A reference symbol 107 represents a RAM for temporarily storing operation results given by the CPU 101 and other data.

By the way, in the apparatus arranged as described above, it is necessary to conduct a print preparatory operation prior to the execution of the printing operation by means of each of the developer cartridges 4Ka to 4Kd. The "print preparatory operation" means an operation or a process to be conducted on the developer cartridges 4Ka to 4Kd prior to the execution of the printing operation in order to enable the printing operation by means of each of the developer cartridges 4Ka to 4Kd. In this embodiment, the following operations and processes are conducted as the "print preparatory operation".

(1) Mounting Confirmation Operation

The mounting confirmation operation is an operation to confirm that the developer cartridges are assuredly mounted to the support frame 40 of the developing unit 4. Specifically, the confirmation is made based on data transmission/reception between the CPU 101 and the individual memories 91 to 94 via the wireless communications carried out between the main body and the individual developer cartridges. In this respect, (2) suitability confirmation operation to be described below is performed the same way. It goes without saying that the mounting of the developer cartridges may also be confirmed by means of a contact system employing a limit switch or the like, instead of using the non-contact system like that of the wireless communications.

(2) Suitability Confirmation Operation

The suitability confirmation operation is an operation to confirm that the developer cartridges mounted to the support frame 40 of the developing unit 4 are the developer cartridges containing therein the black toner. According to the embodiment in particular, the monochromatic image forming apparatus is constituted by mounting the black developer cartridge(s) to mounting position(s) for yellow, cyan and/or magenta developer cartridge(s) which are for use in the color image forming apparatus. Accordingly, the embodiment involves a possibility of a user, operator or the like inadvertently mounting a wrong developer cartridge. On this account, the suitability confirmation operation is conducted to prevent the yellow, cyan or magenta developer cartridge from being mistakenly used.

(3) Life Confirmation Operation

The life confirmation operation is an operation to confirm that a required amount of toner for performing the printing operation remains in the cartridge mounted to the support frame 40 of the developing unit 4. The occurrence of defects, such as density variations or thin spots in the image formed by the printing operation is obviated by conducting the life confirmation operation.

(4) Agitation Process

The agitation process is a process to cause the developing roller 44 equivalent to the "toner carrier" of the present invention to rotate at least one round. The following is the reason for conducting the agitation process. It has heretofore been known that the image forming apparatus of this type may sometimes encounter the occurrence of periodical density variations in an image when the printing operation is performed after a long period during which the apparatus is turned off or in a standstill where the apparatus does not perform the printing operation (image forming operation) although the power is on. It is noted that this phenomenon is referred to as "shutdown-induced banding phenomenon" in this specification.

The shutdown-induced banding phenomenon is thought to result from the fact that since the toner is left to stand for long hours being carried on the developing roller 44 of each developer cartridge, the toner becomes inseparable from the developing roller 44, and besides, the toner on a surface of the developing roller 44 exhibits various degrees of inseparability so that the toner layer on the developing roller 44 is gradually varied in thickness. Consequently, in the image forming apparatus of this embodiment, an "agitation demanding" signal is generated to cause the developing roller 44 to idle when a condition of arising the shutdown-induced banding phenomenon is satisfied, like when the duration of the standstill exceeds a predetermined time period. Specifically, a rotary driver (not shown) in the main body causes the developing roller 44 to rotate at least one round. Thus, since the toner layer on the surface of the developing roller 44 is refreshed so that a toner layer of a more consistent thickness may be used for the developing process, the density variations due to the shutdown-induced banding phenomenon are less likely to occur.

(5) Patch Process (Condition Control Process)

The patch process is an optimization process to adjust a printing operation condition to a predetermined optimum condition, the printing operation condition under which the printing operation is performed by means of the developing cartridge. This process is the same as those that have heretofore been used widely in the art for stabilizing the image quality. In this embodiment, a "patch control demanding" signal is generated at a suitable time immediately after turn-on of the apparatus so as to carry out the patch process in parallel with the warm-up of the apparatus. In addition, the "patch control demanding" signal is also generated at time when the sleep mode is cancelled, when an opened apparatus cover is closed, or when an operation of replacing the developer cartridge is completed, thus demanding the execution of the patch process.

Next, a print preparatory process conducted prior to the printing process in the apparatus shown in FIG. 1 is described with reference to FIGS. 3 through 6. In the interest of promoting the comprehension of the contents of the invention, the description is made on the case where, as shown in FIG. 1, the four developer cartridges 4Ka to 4Kd are mounted to the developing unit 4.

Figure 3:
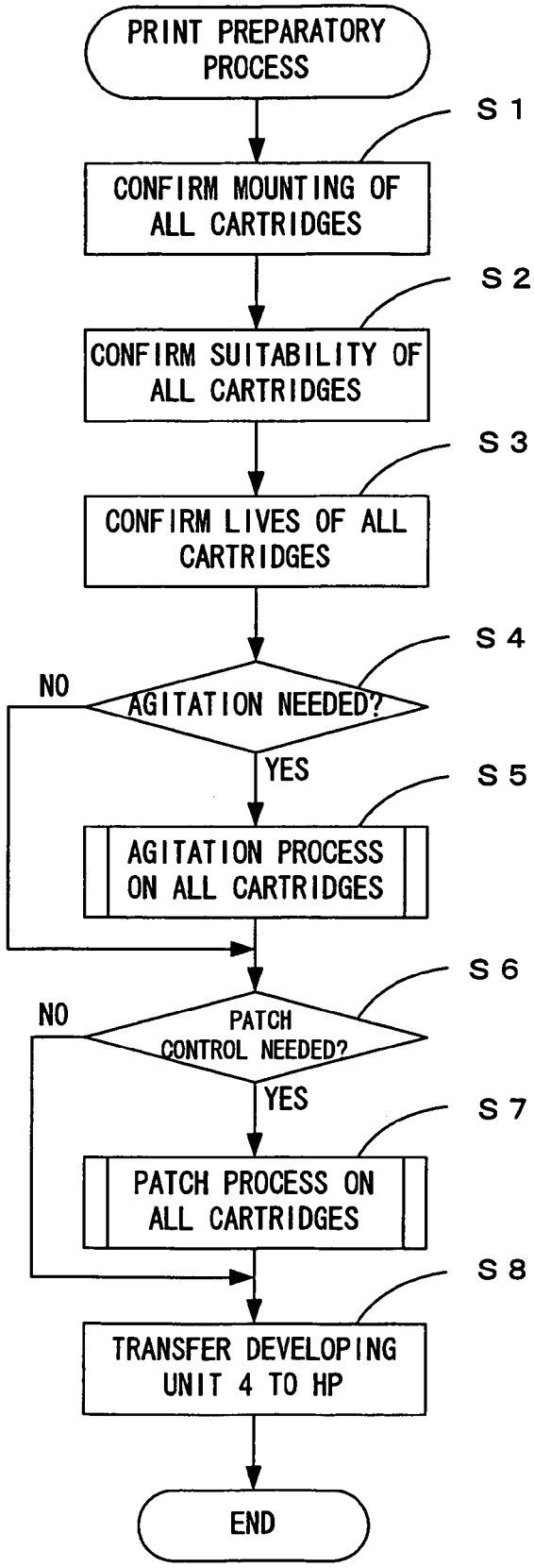
FIG. 3 is a flow chart showing a print preparatory process conducted in the image forming apparatus of FIG. 1.

FIG. 3 is a flow chart showing a print preparatory process conducted in the image forming apparatus of FIG. 1. FIG. 4 is a schematic diagram showing the print preparatory operation. In this apparatus, at a proper time prior to the execution of the printing operation, for example, immediately after the turn-on of the apparatus, the CPU 101 controls the individual parts of the apparatus based on the program stored in the ROM 106 thereby carrying out the print preparatory process shown in FIG. 3. That is, in this embodiment, the CPU 101 functions as a "controller" of the present invention.

First, the transmission/reception of the data between the CPU 101 and each of the memories 91 to 94 is carried out via wireless communications, so that the various information items, such as the consumable article management, relating to the individual developer cartridges 4Ka to 4Kd are temporarily stored in the RAM 107. Based on the information stored in the memory 107, the mounting confirmation operation (Step S1), the suitability confirmation operation (Step S2) and the life confirmation operation (Step S3) are conducted on all the developer cartridges 4Ka to 4Kd (column (a) of FIG. 4).

In Step S4, determination is made as to whether the "agitation demanding" signal is generated or not. This is a process for preventing the shutdown-induced banding phenomenon. Therefore, if the "agitation demanding" signal is not generated, the control proceeds directly to Step S6, and if the "agitation demanding" signal is generated on the other hand, the agitation process (Step S5) shown in FIG. 5 is conducted on all the developer cartridges 4Ka to 4Kd.

Figure 5:
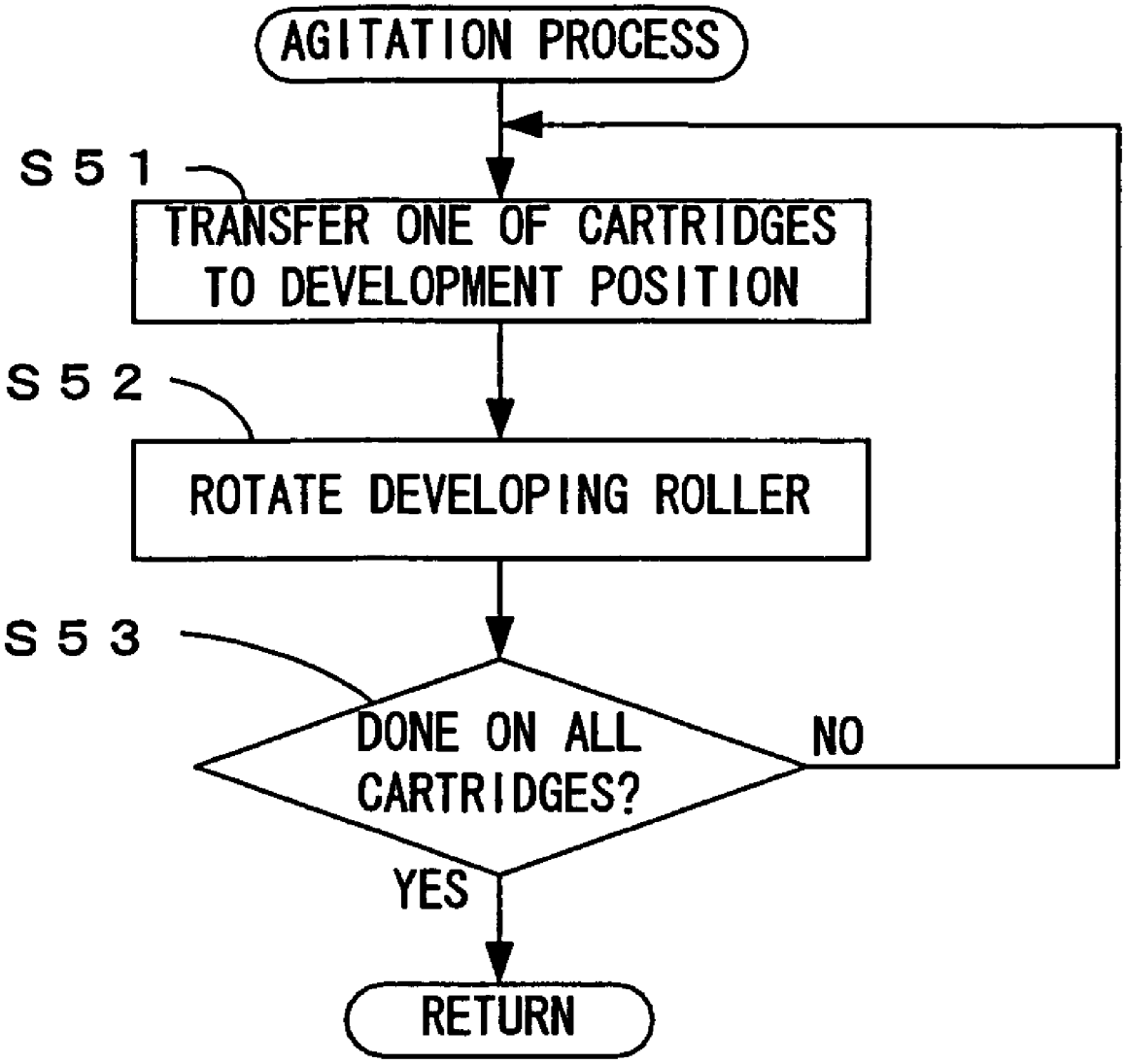
FIG. 5 is a flow chart showing an agitation process conducted in the apparatus of FIG. 1.

FIG. 5 is a flow chart showing the agitation process conducted in the apparatus of FIG. 1. In this agitation process, as shown in column (b) of FIG. 4, the first cartridge 4Ka of the four developer cartridges is transferred to the development position (Step S51). This brings the developing roller 44 of the developer cartridge 4Ka into mechanical connection with the rotary driver in the main body. The rotary driver causes the developing roller 44 (DR in column (b) of FIG. 4) to rotate at least one round so as to refresh the toner layer on the surface of the developing roller 44, thereby accomplishing the agitation process on the developer cartridge 4Ka (Step S52). The operations of Steps S51 and S52 are repeated so long as the result of the determination in Step S53 is "NO". Specifically, the developing roller 44 is caused to rotate at least one round when each of the developer cartridges 4Kb to 4Kd is transferred to the development position (columns (c) to (e) of FIG. 4).

When the agitation process is thus completed (Step S5), the control proceeds to Step S6 to determine whether the "patch control demanding" signal is generated or not. This is a process to adjust the printing operation condition to the predetermined optimum condition. Therefore, if the "patch control demanding" signal is not generated, after the developing unit 4 is transferred to HP (Step S8), the print preparatory process is terminated, and if the signal is generated on the other hand, the patch process shown in FIG. 6 is conducted on all the developer cartridges 4Ka to 4Kd (Step S7).

Figure 6:
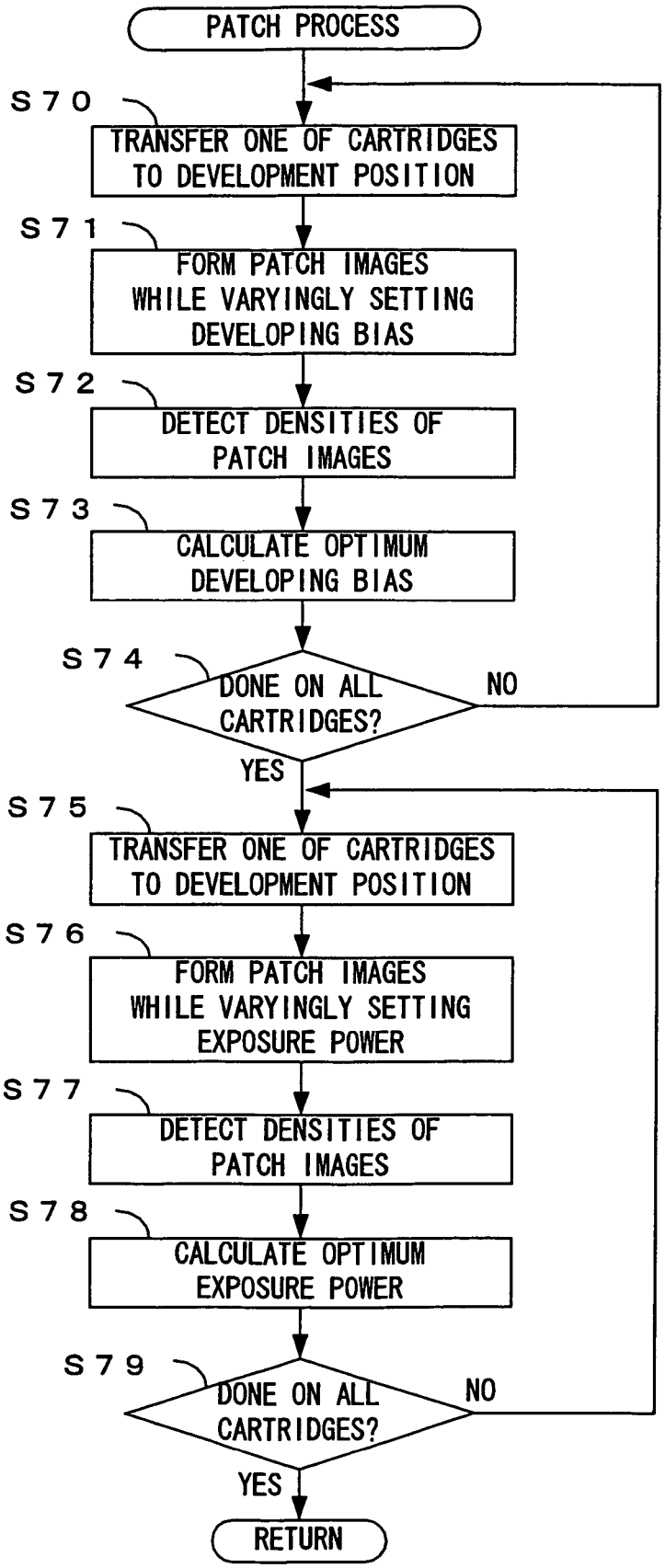
FIG. 6 is a flow chart showing a patch process conducted in the apparatus of FIG. 1.

FIG. 6 is a flow chart showing the patch process conducted in the apparatus of FIG. 1. The patch process is a process, in order to maintain a certain quality of the images formed by performing the printing operation, to form individual patch images while setting the printing operation condition varyingly in different values, to detect the image densities of the formed images, and to adjust the printing operation condition based on the detection results. In this patch process, out of the operation parameters which determine the operating conditions of the individual parts of the apparatus, the developing bias and the exposure power, as the control factors affecting the image quality, are adjusted. In addition to these parameters, there are known other various operation parameters which function as the control factors. Since there are a large number of known techniques relating to the principles of the image quality control and the control method using these operation parameters, only the flow of the process is briefly described here.

First, for each of the developer cartridges 4Ka to 4Kd, the optimum developing bias, that is, the optimum value of the developing bias to be applied to the developing roller 44 during the printing operation is calculated. Specifically, as shown in column (b) of FIG. 4, one developer cartridge 4Ka of the developer cartridges is selectively transferred to the development position (Step S70). While setting the developing bias varyingly in multiple levels, each of the patch images of a predetermined pattern is formed with each level of the developing bias by means of the developer cartridge 4Ka (Step S71). Then, the image density of each of the patch images is detected by means of the density sensor 60 (Step S72).

When the image densities of the individual patch images are determined, the corresponding relation between the developing bias and the image density can be determined from these values. Hence, such a value of the developing bias as to match the image density with a predetermined target density is calculated based on the relation thus determined. Thus is determined the optimum developing bias (Step S73). It is noted however that if the determined optimum value is not within the variable range of the developing bias of the apparatus, any one of the values in the variable range that is the closest to the calculated optimum value may be defined as the optimum developing bias.

When the optimum developing bias for one developer cartridge 4Ka of the developer cartridges is determined, the above processes S70 to S73 are repeated till the termination of the process on all the developer cartridges (Step S74). Specifically, the optimum developing bias for each of the developer cartridges 4Kb to 4Kd is determined each time each of the developer cartridges is transferred to the development position (columns (c) to (e) of FIG. 4). In this manner, the optimum developing bias is determined for each of the developer cartridges 4Ka to 4Kd.

Subsequently, for each of the developer cartridges 4Ka to 4Kd, the optimum exposure power, that is, the optimum value of the intensity of the light beam L in forming, on the photosensitive member 22, the electrostatic latent image corresponding to the cartridge is calculated (Steps S75 to S79). This process is conducted the same way as the aforementioned process for calculating the optimum developing bias (Steps S70 to S74), except that the control factor is the exposure power instead of the developing bias. However, the image pattern of the patch images to be formed may be changed to a different one, if it is necessary. It is noted that this process may preferably set the developing bias to the previously determined optimum value thereof. In this manner, the optimum developing bias and the optimum exposure power for all the developer cartridges are determined respectively and the patch process is terminated.

By conducting such a print preparatory operation (the mounting confirmation operation, the suitability confirmation operation, the life confirmation operation, the agitation process, the patch process), as shown in column (f) of FIG. 4, all the developer cartridges 4Ka to 4Kd are placed in the printable state in which the printing operation is conducted satisfactory. Now returning to FIG. 3, the developing unit 4 is transferred to the home position (HP) and stands ready (Step S8). Then, the execution of the image forming operation by the engine section EG is permitted. The subsequent printing operation is performed under the optimum conditions, thereby ensuring that the images of a desired image quality can be formed in a stable manner.

As described above, according to this embodiment, prior to the execution of the printing operation, all the developer cartridges 4Ka to 4Kd mounted to the developing unit 4 are collectively brought into the printable state by conducting the print preparatory operation on all the developer cartridges. Therefore, even if the residual quantity of toner contained in the cartridge runs too low to continue the printing operation while performing the printing operation using one cartridge of the developer cartridges 4Ka to 4Kd mounted to the developing unit 4, for example, it is possible to continue the printing operation by immediately switching to the next cartridge. Furthermore, such a print succession process may be applied to all the cartridges and hence, a large volume of monochromatic prints can be produced efficiently.

Second Embodiment

By the way, in the apparatus arranged as described above, a print preparatory operation is required to be conducted prior to the execution of the printing operation by means of each of the developer cartridges 4Ka to 4Kd. However, it is inefficient in terms of time and economy to conduct the print preparatory operation on the unusable cartridge. Therefore, in this embodiment, the plural cartridges mounted to the developing unit are each checked to determine whether the cartridge is usable or not (usable/unusable determination step) and then, the print preparatory operation is conducted on the usable cartridges which are determined to be usable (preparatory step). The "usable/unusable determination of cartridge" is to determine whether the printing by means of the cartridge becomes possible or not after the print preparatory operation is conducted thereon. The following determination operation is conducted.

(1) Mounting Determination Operation

The mounting determination operation is an operation to determine whether or not the developer cartridges are assuredly mounted to the support frame 40 of the developing unit 4. Specifically, the determination is made based on data acquired by data transmission/reception between the CPU 101 and the individual memories 91 to 94 via the wireless communications carried out between the main body and the individual developer cartridges. In this respect, (2) suitability determination operation to be described below is performed the same way. It goes without saying that the mounting determination of the developer cartridges may also be done by means of a contact system employing a limit switch or the like, instead of using the non-contact system like that of the wireless communications.

(2) Suitability Determination Operation

The suitability determination operation is an operation to determine whether or not the developer cartridges mounted to the support frame 40 of the developing unit 4 are the developer cartridges containing therein the black toner. According to the embodiment in particular, the monochromatic image forming apparatus is constituted by mounting the black developer cartridge(s) to mounting position(s) for yellow, cyan and/or magenta developer cartridge(s) which are for use in the color image forming apparatus. Accordingly, the embodiment involves a possibility of a user, operator or the like inadvertently mounting a wrong developer cartridge. On this account, the suitability determination operation is conducted to prevent the yellow, cyan or magenta developer cartridge from being mistakenly used.

(3) Life Determination Operation

The life determination operation is an operation to determine whether or not a required amount of toner for performing the printing operation remains in the cartridge mounted to the support frame 40 of the developing unit 4. The occurrence of defects, such as density variations or thin spots in the image formed by the printing operation is obviated by conducting the life determination operation.

In addition, the "print preparatory operation" means an operation or a process to be conducted on the usable developer cartridge prior to the execution of the printing operation in order to enable the printing operation by means of the usable cartridge. In this embodiment, the following processes are conducted as the "print preparatory operation".

(a) Agitation Process

The agitation process is a process to cause the developing roller 44 equivalent to the "toner carrier" of the present invention to rotate at least one round. The reason for conducting the agitation process is described above. Consequently, in the image forming apparatus of this embodiment, an "agitation demanding" signal is generated to cause the developing roller 44 to idle when a condition of arising the shutdown-induced banding phenomenon is satisfied, like when the duration of the standstill exceeds a predetermined time period. Specifically, a rotary driver (not shown) in the main body causes the developing roller 44 to rotate at least one round. Thus, since the toner layer on the surface of the developing roller 44 is refreshed so that a toner layer of a more consistent thickness may be used for the developing process, the density variations due to the shutdown-induced banding phenomenon are less likely to occur.

(b) Patch Process (Condition Control Process)

The patch process is an optimization process to adjust a printing operation condition to a predetermined optimum condition, the printing operation condition under which the printing operation is performed by means of the developing cartridge. This process is the same as those that have heretofore been used widely in the art for stabilizing the image quality. In this embodiment, a "patch control demanding" signal is generated at a suitable time immediately after turn-on of the apparatus so as to carry out the patch process in parallel with the warm-up of the apparatus. In addition, the "patch control demanding" signal is also generated at time when the sleep mode is cancelled, when an opened apparatus cover is closed, or when an operation of replacing the developer cartridge is completed, thus demanding the execution of the patch process.

Next, a pre-print process conducted prior to the printing process in the apparatus shown in FIG. 1 is described with reference to FIGS. 7 through 9. In the interest of promoting the comprehension of the contents of the invention, the description is made on the case where, as shown in FIG. 1, the four developer cartridges 4Ka to 4Kd are mounted to the developing unit 4.

Figure 7:
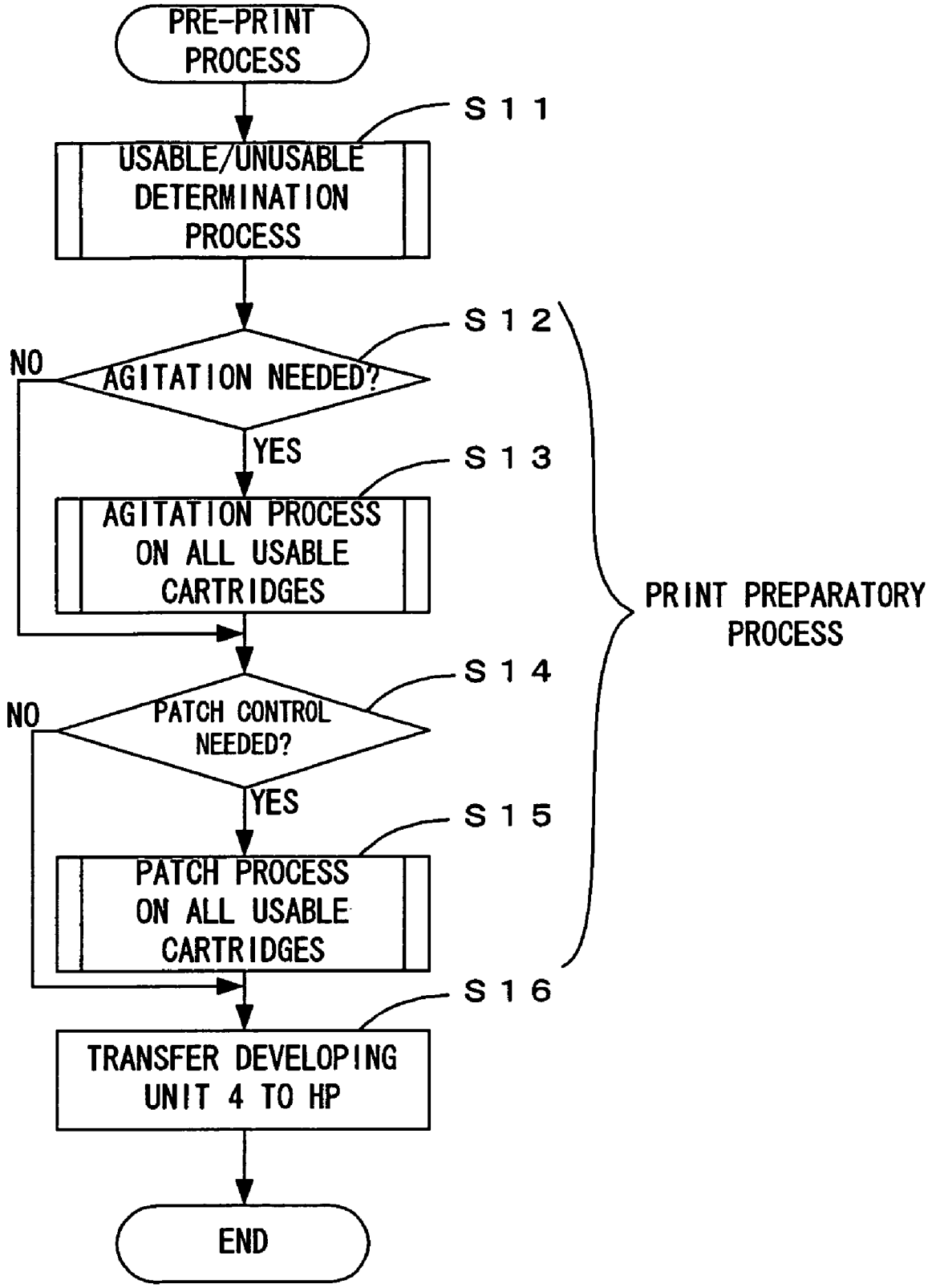
FIG. 7 is a flow chart showing a pre-print process conducted in a second embodiment according to the present invention.

FIG. 7 is a flow chart showing a pre-print process conducted in the image forming apparatus of FIG. 1. FIG. 8 is a schematic diagram showing a pre-print operation. In this apparatus, at a proper time prior to the execution of the printing operation, for example, immediately after the turn-on of the apparatus, the CPU 101 controls the individual parts of the apparatus according to a program stored in the ROM 106, thereby carrying out the pre-print process (a usable/unusable determination process and a print preparatory process) shown in FIG. 7. That is, in this embodiment, the CPU 101 functions as a "controller" of the present invention.

First, the data transmission/reception between the CPU 101 and each of the memories 91 to 94 is carried out via the wireless communications, so that a variety of information items, such as the consumable article management, relating to the individual developer cartridges 4Ka to 4Kd are temporarily stored in the RAM 107. Then, based on the information stored in the memory 107, the usable/unusable determination process shown in FIG. 9 is conducted on all the developer cartridges 4Ka to 4Kd (Step S11).

Figure 9:
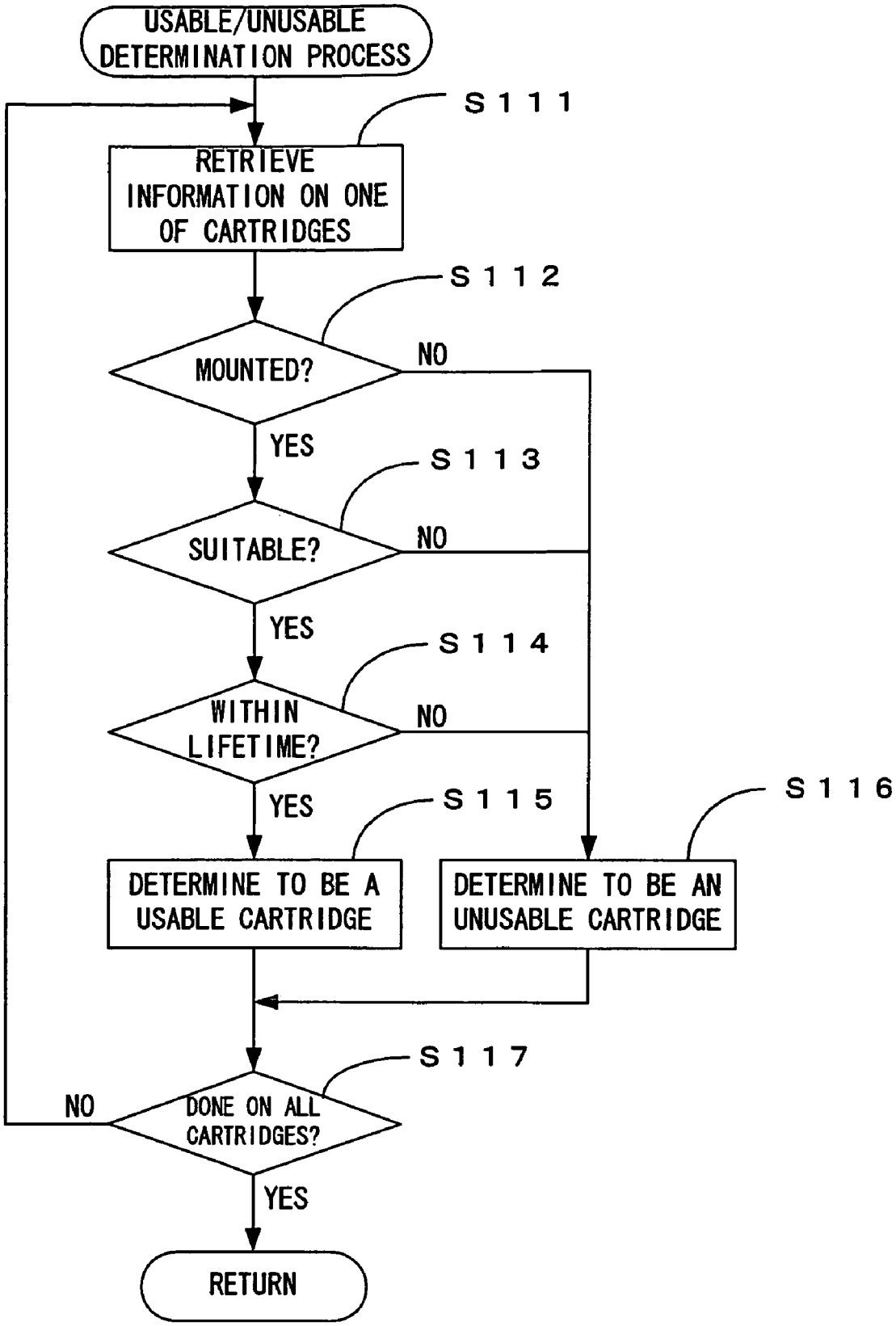
FIG. 9 is a flow chart showing a usable/unusable determination process conducted in the second embodiment.

FIG. 9 is a flow chart showing the usable/unusable determination process. In the usable/unusable determination process, the information on one of the developer cartridges is retrieved from the memory 107 (Step S111), then, a mounting determination operation (Step S112), a suitability determination operation (Step S113), and a life determination operation (Step S114) are conducted (column (a) of FIG. 8). A developer cartridge having passed all the mounting determination, the suitability determination, and the life determination is determined as a usable cartridge (Step S115), and a developer cartridge having failed to pass any one of the above determination operations, on the other hand, is determined as an unusable cartridge (Step S116). Such a series of operations are repeated so long as the result of the determination in Step S117 is "NO", thus, the determinations are made on all the developer cartridges 4Ka to 4Kd. In column (b) of FIG. 8, the developer cartridges 4Ka to 4Kc out of the four developer cartridges 4Ka to 4Kd are determined as the usable cartridges, whereas the remaining cartridge 4Kd is determined as the unusable cartridge. Based on the determination results, the next print preparatory process (Steps S12 to S15) is conducted.

In the print preparatory process, as shown in FIG. 7, determination is made in Step S12 as to whether the "agitation demanding" signal is generated or not. This is a process for preventing the shutdown-induced banding phenomenon. Therefore, if the "agitation demanding" signal is not generated, the control proceeds directly to Step S14, and if the signal is generated on the other hand, an agitation process (Step S13) is conducted on all the usable cartridges 4Ka to 4Kc by switching the cartridge to position at the development position as shown in columns (c) to (e) of FIG. 8. This agitation process is conducted the same way as that conducted in the first embodiment shown in FIG. 5.

When the agitation process (Step S13) is completed, the control proceeds to Step S14 to determine whether the "patch control demanding" signal is generated or not. This is a process to adjust the printing operation condition to the predetermined optimum condition. Therefore, if the "patch control demanding" signal is not generated, the print preparatory process is terminated, and if the signal is generated on the other hand, the patch process (Step S15) is conducted on all the usable cartridges 4Ka to 4Kc by switching the cartridge to position at the development position as shown in columns (c) to (e) of FIG. 8. This patch process is conducted the same way as that conducted in the first embodiment shown in FIG. 6.

By conducting such a print preparatory operation (the agitation process, the patch process), all the usable cartridges 4Ka to 4Kc are placed in the printable state in which the printing operation is conducted satisfactory, as shown in column (f) of FIG. 8. Then, the developing unit 4 is transferred to a home position (HP) and stands ready (Step S16). Then, the execution of the image forming operation by the engine section EG is permitted. The subsequent printing operation is performed under the optimum conditions, thereby ensuring that images of a desired image quality can be formed in a stable manner.

As described above, according to this embodiment, the developer cartridges 4Ka to 4Kd are each checked prior to the printing operation to determine whether the cartridge is usable or not. Subsequently, the print preparatory operation is collectively conducted on all the usable cartridges determined to be usable, thereby bringing the cartridges into a printable state. Therefore, the print preparatory operation on the unusable cartridge is assuredly prevented, thereby increasing the efficiency in terms of time and economy. Furthermore, even if the residual quantity of toner contained in the cartridge runs too low to continue the printing operation while performing the printing operation using one of the plural usable cartridges 4Ka to 4Kc mounted to the developing unit 4, for example, it is possible to continue the printing operation by immediately switching to the next usable cartridge. In addition, such a succession process may be applied to all the usable cartridges and hence, a large volume of monochromatic prints can be produced in an efficient manner.

Third Embodiment

Figure 10:
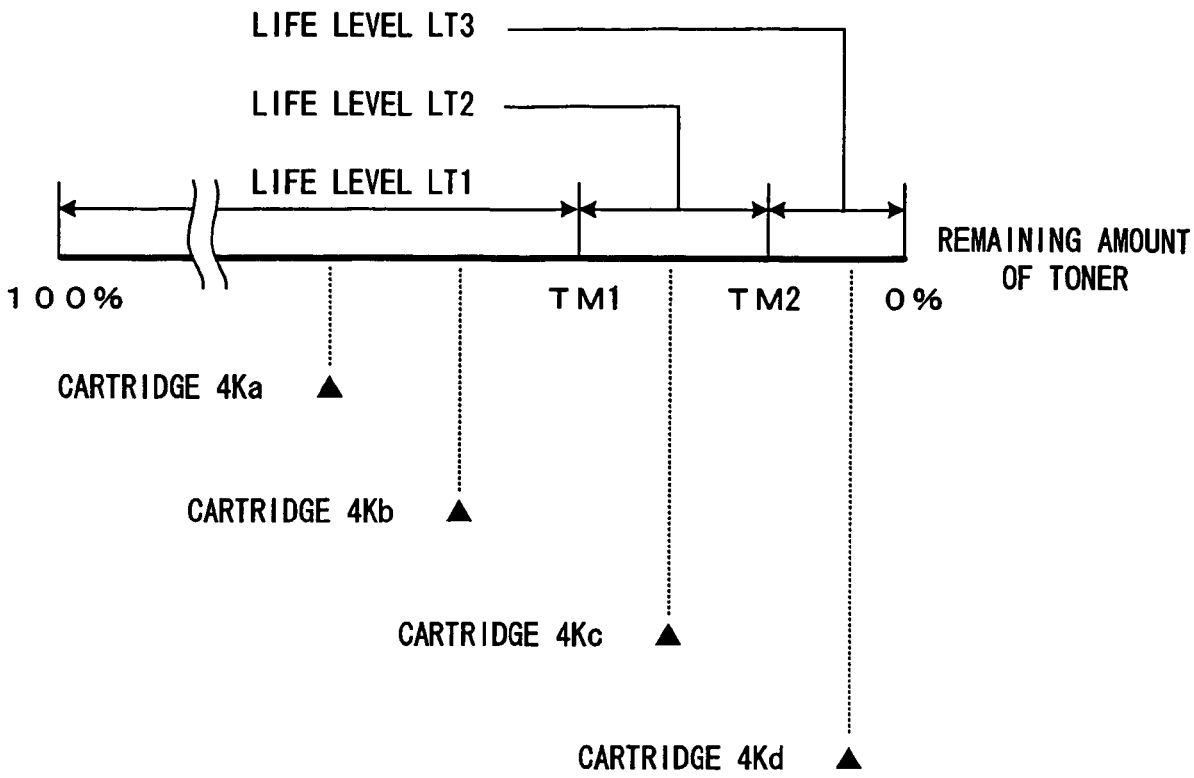
FIG. 10 is a schematic diagram showing a relation between a remaining amount of toner and a life level.

By the way, in the life determination operation according to the embodiment described above, whether or not a required amount of toner for performing the printing operation remains in the cartridge is determined. In other words, life is determined by two levels "life-remaining" and "life-expired". However, even in the cases that a required amount of toner for performing the printing operation remains sufficiently in the developer cartridge, printing quality may be different from each other depending upon remaining amount of toner. In other words, as the remaining amount of toner in the developer cartridge decreases, printing quality may deteriorate gradually even the printing operation itself is possible. Furthermore, the tolerance level against the deterioration of the printing quality is different for each of users. Consequently, it may be contemplated to subdivide the life determination level based on the remaining amount of toner in the cartridge to respond to the difference of the user's tolerance level. For example, as shown in FIG. 10, it is one of the effective measures for providing a user-friendly apparatus to subdivide the life determination level into the following three levels.

Life Level LT1 (Equivalent to a "First Life Level" of the Present Invention):

A printing operation is executable by means of a cartridge of this life level LT1. And besides, not less than a quality assurance toner amount TM1 remains in the cartridge of the life level LT1, the quality assurance toner amount TM1 being the amount required to assure the printing quality when the printing operation is performed. Therefore, even when the printing is performed continuously using this cartridge, it is possible to execute printing in high quality in a stable manner, regardless of user's tolerance level.

Life Level LT2 (Equivalent to a "Second Life Level" of the Present Invention):

A remaining amount of toner in a cartridge of this life level LT2 is less than the quality assurance toner amount TM1, but more than a printing limit toner amount TM2, the printing limit toner amount TM2 being the amount prohibited to perform the printing operation. In other words, although the printing operation is executable using this cartridge, the toner amount remaining in this cartridge is less than the quality assurance toner amount TM1. In this case, although it is possible to perform the printing operation itself, the printing quality may deteriorate beyond the user's tolerance level while the printing operation is performed continuously. On the other hand, however, it is possible to use the toner in the cartridge up to near the printing limit toner amount TM2, thereby contributing greatly to the reduction of running cost.

Life Level LT3 (Equivalent to a "Third Life Level" of the Present Invention):

A remaining amount of toner in a cartridge of this life level LT3 reaches to the printing limit toner amount TM2. If the printing operation is performed using this cartridge, a breakdown or a failure may occur in the individual parts of the apparatus. In other words, the remaining toner amount is reduced to a degree that the printing operation is not executable by means of this cartridge.

Therefore, in the embodiment that the life level is thus subdivided into three levels, the developer cartridge may be determined to be usable in the case where the life level of the cartridge is determined to be the life level LT1 or LT2. For example, as shown in FIG. 10, since the remaining amount of toner in each of the cartridges 4Ka and 4Kb is not less than the quality assurance toner amount TM1, the life level thereof is the life level LT1. Since the remaining amount of toner in the cartridge 4Kc is less than the quality assurance toner amount TM1 but more than the printing limit toner amount TM2, the life level of the cartridge 4Kc is the life level LT2. Consequently, these developer cartridges 4Ka to 4Kc are determined to be usable, on which the print preparatory operation is conducted. As a result, the same effect is acquired according to the above embodiment.

Fourth Embodiment

Incidentally, a following problem may occur in the case where the developer cartridges of which the life level is different from each other are directly determined to be "usable cartridges" as in the third embodiment described above. That is, while a continuous printing is performed using the developer cartridge of the life level LT2, the printing quality may fall to below the user's tolerance level. Therefore, in this embodiment, when the cartridge of the life level LT1 is mixed with the cartridge of the life level LT2 in the plurality of usable cartridges, the usable cartridge is narrowed down to the cartridge of the life level LT1. Consequently, the print preparatory operation is conducted only on the usable cartridge or the developer cartridge of the life level LT1. Hereinafter, a detailed description of this embodiment is made referring to FIGS. 10 through 12.

Figure 11:
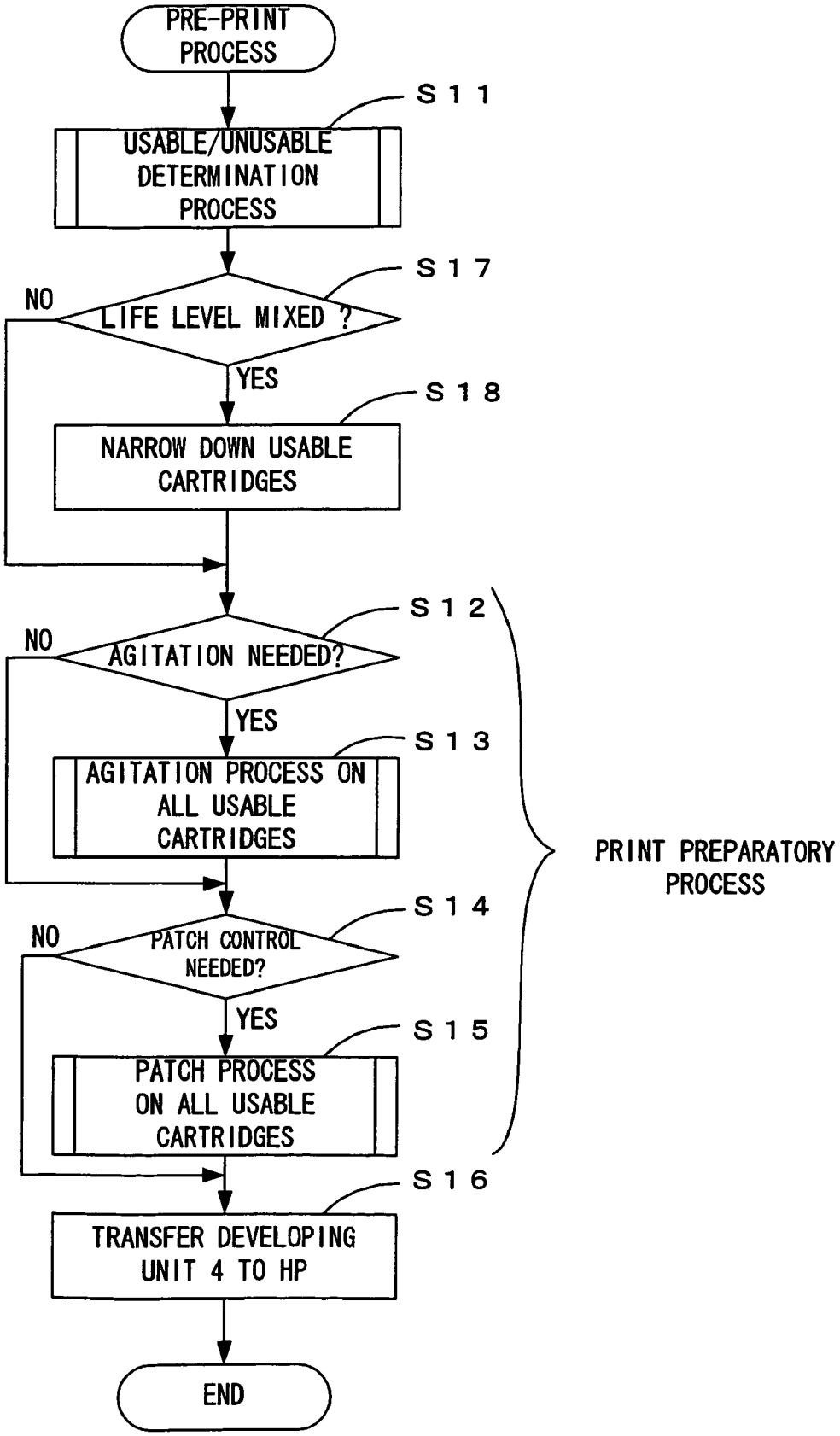
FIG. 11 is a flow chart showing a pre-print process conducted in a fourth embodiment according to the present invention.

FIG. 11 is a flow chart showing a pre-print process conducted in the fourth embodiment of an image forming apparatus according to the present invention. FIG. 12 is a schematic diagram showing a pre-print operation. This fourth embodiment principally differs from the foregoing embodiments in that determination is made (Step S17) as to whether or not the different life levels are mixed among the developer cartridges determined to be usable in the usable/unusable determination process (Step S11), and that if the different life levels are mixed, usable cartridges are narrowed down (Step S18). Since other structures and operations are the same, the same reference symbols are denoted thereat and the description thereof is dispensed with. In the interest of promoting the comprehension of the contents of the invention, the description is made on the case where, as shown in FIGS. 10 and 12, two developer cartridges 4Ka and 4Kb of the life level LT1, one developer cartridge 4Kc of the life level LT2, and one developer cartridge 4Kd of the life level LT3 are mounted to the developing unit 4.

First, the data transmission/reception between the CPU 101 and each of the memories 91 to 94 is carried out via the wireless communications, so that a variety of information items, such as the consumable article management, relating to the individual developer cartridges 4Ka to 4Kd are temporarily stored in the RAM 107. Then, based on the information stored in the memory 107, the usable/unusable determination process shown in FIG. 9 is conducted on all the developer cartridges 4Ka to 4Kd (Step S11). As a result, out of four developer cartridges 4Ka to 4Kd, developer cartridges 4Ka to 4Kc are determined to be usable and the remaining cartridge 4Kd is determined to be unusable, as shown in column (b) of FIG. 12.

Consequently, at the next Step S17, the life levels of the developer cartridges 4Ka to 4Kc are compared each other to be determined that the cartridges 4Ka, 4Kb of the life level LT1 and the cartridge 4Kc of the life level LT2 are mixed (column (c) of FIG. 12). Then, usable cartridges are narrowed down to cartridges 4Ka and 4Kb (Step S18). It is noted here that if the cartridge of the life level is not mixed, that is, the life level of each of the usable cartridges is the life level LT1 or the life level of each of the usable cartridges is the life level LT2 (NO at Step S17), the developer cartridges determined to be usable at Step S11 are directly defined as usable cartridges.

After usable cartridges are thus narrowed down corresponding to the life level, the print preparatory operation is conducted on the usable cartridges in the same way as the above embodiments (Steps S12 to S16).

As described above, according to this embodiment, it is possible to resolve the problem which occur in the case where a continuous printing is performed in an apparatus in which the developer cartridge of the life level LT1 and the developer cartridge of the life level LT2 are mixed among the mounted cartridges. That is, even if the developer cartridges of the life level LT2 are included in part of the plural cartridges mounted to the developing unit 4, continuous printing is performed using only the cartridges of the life level LT1. Hence, it is possible to produce a great amount of monochromatic printing in a efficient manner, while preventing from deteriorating the printing quality during the continuous printing.

Fifth Embodiment

In addition, in the second through fourth embodiments described above, although the print preparatory operation is conducted on all the usable cartridges after the determination of the usable cartridges, there is a case that the printing operation is executable using a part of the cartridge as is, that is, on which the agitation process and the patch process have already been conducted so that the print preparatory operation is not necessary. In this case, it may be arranged that the print preparatory operation is conducted collectively on the plural cartridges determined to be usable except for printable cartridges which are already capable of printing operation. A case is considered, for example, where the following three kinds of cartridges are mounted to the developing unit 4, as shown in FIG. 13.

In this embodiment, printable cartridges 4Ka and 4Kb, an unprintable cartridge 4Kc, and an unusable cartridge 4Kd are mounted to the developing unit 4. The printable cartridges 4Ka, 4Kb are usable cartridges, and besides the agitation process and the patch process have already been completed whereby capable of executing the printing operation as is. The unprintable cartridge 4Kc is an usable cartridge, but the print preparatory operation is required to become capable of performing the printing operation. Therefore, the cartridges 4Ka to 4Kc are determined to be usable in the usable/unusable determination process (Step S11). Consequently, the print preparatory operation is conducted only on the unprintable cartridge 4Kc. Hence, all three developer cartridges 4Ka to 4Kc becomes printable cartridges, thereby enabling the monochromatic printing in a great quantity using these cartridges 4Ka to 4Kc. Furthermore, according to this embodiment, the print preparatory operation may be skipped on a specified cartridge, hence the print preparatory operation may be conducted more efficiently.

Others

It is to be noted that the present invention is not limited to the foregoing embodiments and various changes and modifications other than the above may be made thereto unless such changes and modifications depart from the scope of the invention. For instance, in the foregoing embodiments, up to four developer cartridges can be mounted to the support frame 40 of the developing unit 4 and the developer cartridges 4Ka to 4Kd are mounted to all the mounting positions, but the present invention may be applied to an apparatus wherein the developer cartridges are mounted to only some of the mounting positions. That is, in an apparatus wherein M ($M \geqq 2$) developer cartridges, less than a mountable number, are mounted to the developing unit 4, as well, the print preparatory operation is conducted collectively on all these M developer cartridges, thereby performing the printing efficiently by means of the M developer cartridges. Further, although the number of the mountable cartridges is four in the foregoing embodiments, the number is arbitrary. And the number M is also arbitrary on the condition that the number is not less than two and not more than the number of the mountable cartridges. Therefore, the present invention is also applicable to an image forming apparatus, for example, wherein the developing unit 4 is designed to allow five or more developer cartridges to be mounted to the support frame 40, wherein the yellow, cyan and magenta developer cartridges are mounted to three mounting positions, and wherein the black developer cartridges are mounted to the rest of the mounting positions.

Further, in the foregoing embodiments, although the present invention is applied to the image forming apparatus defining the specific color as black, the specific color is not limited to this.

Further, in the foregoing embodiments, the rotary development system is adopted wherein a plurality of developer cartridges are mounted to the developing unit 4, so that the toner contained in the individual developer cartridges is agitated in the cartridges in conjunction with the rotating movement of the developing unit 4, thereby homogenizing the toner. Consequently, toner agitation by way of the rotating operation of the developing unit 4 may be conducted as the print preparatory operation. Further, it has been a conventional practice to adopt a technique wherein a member such as an agitator or an auger rod is disposed in the developer cartridge for agitating the toner in the developer cartridge or for actively feeding the toner to the developing roller. Consequently, in an apparatus equipped with the member such as the agitator or the auger rod, the toner agitation or the toner feeding by means of the member may be conducted as the print preparatory operation.

Further, in the foregoing embodiments, although the agitation process and the patch process are conducted in this order as the print preparatory operation, the agitation process may be skipped on the cartridge on which the patch process is required, since the developing roller 44 rotates by necessity in conducting the patch process.

Further, in the foregoing embodiments, although an arrangement is adopted to use up the toner contained in the developer cartridge, in an apparatus employing a developer cartridge of a type to be replenished with the toner as needed, a toner replenishment operation may also be conducted as the print preparatory operation.

Further, in the foregoing embodiments, although the four developer cartridges 4Ka to 4Kd having the same configuration are used, it is also possible to employ developer cartridges having configurations different from each other. Further, in the foregoing embodiments, the present invention is applied to the image forming apparatus of a so-called rotary system, wherein the rotary developing unit 4 is disposed against one photosensitive member 22, but the present invention may also be applied to an image forming apparatus of an elevator system wherein a plurality of developer cartridges are moved up and down relative to one photosensitive member 22 for carrying out the development process, or an image forming apparatus of a so-called tandem system.

Furthermore, the present invention is not limited to the arrangements of the foregoing embodiments, but applicable to, for example, an apparatus which is equipped with a developing unit to which a plurality of developer cartridges having toner of a specific color are mounted and which forms an image of the specific color, an apparatus which is equipped with a transfer medium other than the intermediate transfer belt (such as a transfer drum or a transfer sheet), and other image forming apparatuses such as copiers and facsimiles.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a latent image carrier capable of carrying thereon an electrostatic latent image;

a developing unit having a plurality of cartridges which are freely mounted to and removed from said developing unit and which contain toner of a specific color; and a controller which performs a printing operation while selectively transferring one of the plurality of cartridges mounted to said developing unit at a development position, the printing operation in which the electrostatic latent image on said latent image carrier is developed using the toner in the cartridge positioned at the development position, wherein said controller conducts a print preparatory operation collectively on all the plurality of cartridges mounted to said developing unit, the print preparatory operation conducted on the cartridges prior to the printing operation in order to enable the printing operation by means of the cartridges.

2. The image forming apparatus of claim 1, wherein said controller conducts, as the print preparatory operation, a mounting confirmation operation to confirm that the cartridges are mounted to said developing unit.

3. The image forming apparatus of claim 1, wherein said controller conducts, as the print preparatory operation, a suitability confirmation operation to confirm that the cartridges mounted to said developing unit have the toner of the specific color.

4. The image forming apparatus of claim 1, wherein said controller conducts, as the print preparatory operation, a life confirmation operation to confirm that a required amount of toner to perform the printing operation remains in the cartridge mounted to said developing unit.

5. The image forming apparatus of claim 1, wherein

M ($M \geqq 2$) cartridges are mounted to said developing unit, and said controller conducts the print preparatory operation collectively on all the M cartridges mounted to said developing unit in a case where M is less than a number of cartridges mountable to said developing unit.

6. The image forming apparatus of claim 1, wherein said controller checks each of the plurality of cartridges mounted to said developing unit to determine whether the cartridge is usable or not, and conducts the print preparatory operation collectively on all the cartridges determined to be usable.

7. The image forming apparatus of claim 1, wherein said controller checks each of the plurality of cartridges mounted to said developing unit to determine whether the cartridge is usable or not, and conducts the print preparatory operation collectively on the cartridges determined to be usable except for a printable cartridge which is already capable of the printing operation.

8. The image forming apparatus of claim 6, wherein said controller determines whether the cartridge is usable or not based on whether the cartridge is mounted to said developing unit or not.

9. The image forming apparatus of claim 6, wherein said controller determines whether the cartridge is usable or not based on whether the cartridge mounted to said developing unit has the toner of the specific color or not.

10. The image forming apparatus of claim 6, wherein said controller determines whether the cartridge is usable or not based on whether or not a required amount of toner to perform the printing operation remains in the cartridge mounted to said developing unit.

11. The image forming apparatus of claim 6, wherein said controller checks each of the plurality of cartridges mounted to said developing unit and determines a life level of the cartridge to be a first life level in a case where the printing operation is executable by means of the cartridge, and besides not less than a quality assurance toner amount remains in the cartridge, the quality assurance toner amount being an amount required to assure a printing quality when the printing operation is performed;

a second life level in a case where the printing operation is executable by means of the cartridge, but less than the quality assurance toner amount remains in the cartridge; and a third life level in a case where the printing operation is not executable by means of the cartridge, and wherein said controller determines the cartridge of the first life level and the second life level to be usable, and the cartridge of the third life level to be unusable.

12. The image forming apparatus of claim 11, wherein said controller determines only the cartridge of the first life level to be usable in a case where the cartridge of the first life level and the cartridge of the second life level are mixed among the plurality of cartridges mounted to said developing unit.

13. The image forming apparatus of claim 6, wherein

M (M≧2) cartridges are mounted to said developing unit, and said controller checks each of the M cartridges mounted to said developing unit to determine whether the cartridge is usable or not, and conducts the print preparatory operation collectively on all the cartridges determined to be usable, in a case where M is less than a number of cartridges mountable to said developing unit.

14. The image forming apparatus of claim 1, wherein each of the plurality of cartridges comprises a toner carrier which rotates in a predetermined direction while carrying toner on its surface thereby conveying the toner to a position opposite to said latent image carrier, and said controller conducts, as the print preparatory operation, an agitation process to cause the toner carrier to rotate at least one round.

15. The image forming apparatus of claim 1, wherein said controller conducts, as the print preparatory operation, a condition control process to adjust a printing operation condition to a predetermined optimum condition, the printing operation condition under which the printing operation is performed by means of the cartridge mounted to said developing unit.

16. An image forming method of an apparatus which comprises a latent image carrier capable of carrying thereon an electrostatic latent image, and a developing unit having a plurality of cartridges which are freely mounted to and removed from said developing unit and which contain toner of a specific color, wherein a printing operation is executed while selectively transferring one of the plurality of cartridges mounted to said developing unit to a development position, the printing operation in which the electrostatic latent image on said latent image carrier is developed using the toner in the cartridge positioned at the development position, and a print preparatory operation is conducted collectively on each of the plurality of cartridges mounted to said developing unit, the print preparatory operation conducted on the cartridge prior to the execution of the printing operation to enable the printing operation by means of the cartridge.

17. The image forming method of claim 16, wherein following steps are executed prior to the execution of the printing operation;

a usable/unusable determination step of checking each of the plurality of cartridges mounted to said developing unit to determine whether the cartridge is usable or not, and a preparatory step of conducting the print preparatory operation collectively on all the cartridges determined to be usable in said usable/unusable determination step.

18. The image forming method of claim 16, wherein following steps are executed prior to the execution of the printing operation;

a usable/unusable determination step of checking each of the plurality of cartridges mounted to said developing unit to determine whether the cartridge is usable or not, and a preparatory step of conducting the print preparatory operation collectively on the cartridges determined to be usable in said usable/unusable determination step except for a printable cartridge which is already capable of the printing operation.

* * * * *